US005087411A

United States Patent [19]

Guironnet et al.

[11] Patent Number: 5,087,411

[45] Date of Patent: Feb. 11, 1992

[54] DEVICE AND PROCESS FOR UNDERWATER RECOVERY AND ELIMINATION OF RADIOACTIVE WASTE

[75] Inventors: Louis Guironnet, Lyons; Michel Bline, L'Arbresele, both of France

[73] Assignees: Framatome, Courbevoie; Cogema, Dautier, both of France

[21] Appl. No.: 409,490

[22] Filed: Sep. 19, 1989

[30] Foreign Application Priority Data

Sep. 19, 1988 [FR] France ..... 88 12210

[51] Int. Cl.[5] ..... G21C 19/42

[52] U.S. Cl. ..... 376/310; 376/313

[58] Field of Search ..... 376/310, 316, 309, 313; 210/237

[56] References Cited

U.S. PATENT DOCUMENTS 3,928,202 12/1975 Raubenheimer ..... 210/169
4,610,838 9/1986 Gasparro et al. ..... 376/310
4,959,146 9/1990 Kristan ..... 376/310

FOREIGN PATENT DOCUMENTS 2092885 8/1982 United Kingdom .

*Primary Examiner*—Brooks H. Hunt
*Assistant Examiner*—Frederick H. Voss
*Attorney, Agent, or Firm*—Pollock, Vande Sande & Priddy

[57] ABSTRACT

The device comprises a pipe for aspiration and delivery of water from a well, a column suspended from a traveling crane located above the well and an aspiration head fixed at the end of the column opposite to the crane. The aspiration head is composed of two hollow walls assembled to one another, between which there is a filtration wall separating the internal volume of the head into a first part having an aspiration opening and a second part connected via a conduit to the aspiration pipe.

12 Claims, 4 Drawing Sheets

FIG.5
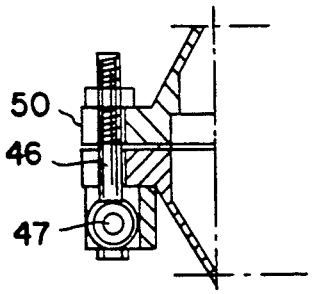
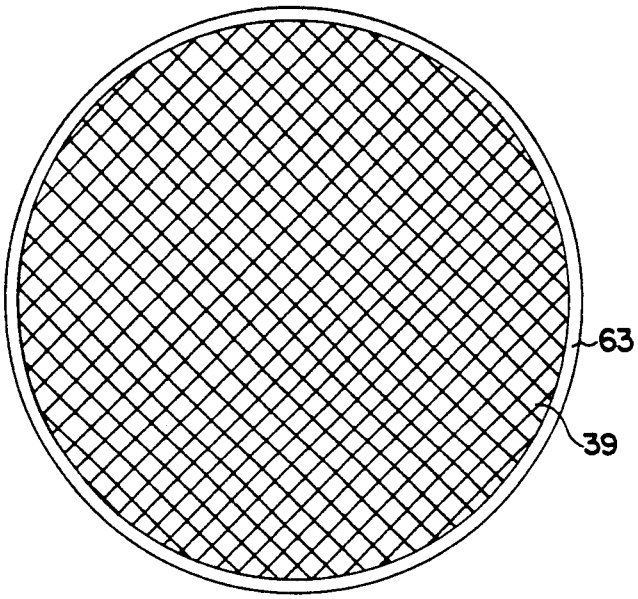
FIG.7
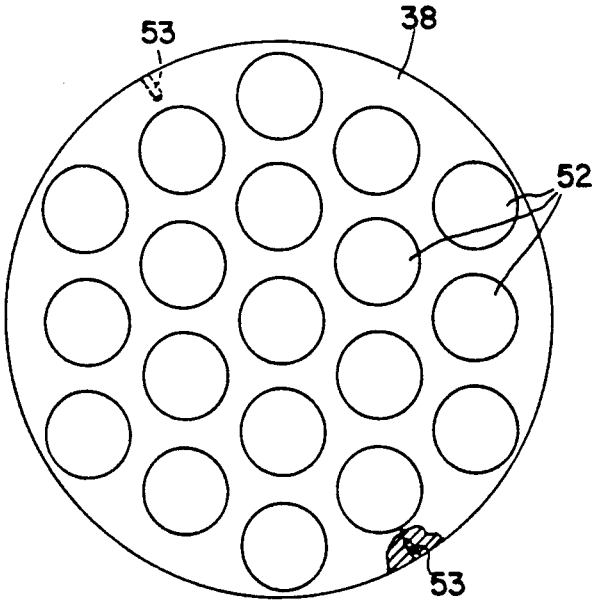
FIG.6

DEVICE AND PROCESS FOR UNDERWATER RECOVERY AND ELIMINATION OF RADIOACTIVE WASTE

FIELD OF THE INVENTION

The invention relates to a device for the recovery and elimination of radioactive waste under water, in a well such as the well of a pressurized-water nuclear reactor or the well for deactivating the fuel.

BACKGROUND OF THE INVENTION

In the course of the operation of light-water nuclear reactors and, in particular, of pressurized-water nuclear reactors, there are carried out, during more or less prolonged shutdowns of the reactor, operations of recharging of the core consisting in replacing a part of the used fuel assemblies constituting the core. In the course of these recharging operations, there are also carried out the maintenance and the repair of certain items of internal equipment of the vessel of the reactor, in which vessel the core is placed.

During these operations, the vessel of the reactor is open and filled with water, just like the well of the reactor which surmounts and surrounds the vessel; this permits the operators carrying out the maintenance of the reactor to work on the elements situated within the vessel, from the service floor of the well of the reactor, with an effective biological protection consisting of a head of water of at least four meters.

The vessel of the reactor is liable to contain waste or debris which is highly radioactive and which may have become detached from the items of internal equipment or from the core, during the operation of the reactor or during the recharging or maintenance operations.

This debris or waste may consist, for example, of mechanical parts belonging to the internal structures of the reactor which have become damaged and detached during operation, under the effect of corrosion and of wear.

They may also consist of highly radioactive fuel pellets originating from a rod of a fuel assembly which may have been pierced or torn, either under the effect of corrosion in the reactor or as a result of attachment of the fuel assembly, in the course of its handling.

There is a risk that this waste or debris may constitute mobile bodies which are placed in circulation in the cooling fluid of the reactor when it is started up. These mobile bodies, which are entrained at very high speed by the cooling fluid, could damage the structures or to the core of the reactor and become lodged in an interstice, for example between two fuel rods.

Thus, there is a risk that the presence of mobile bodies will have an unfavorable effect on the operation of the reactor, with regard to both mechanical and thermal configurations.

It is therefore necessary to locate and to recover the waste or debris present in the vessel of the reactor, during the recharging and maintenance operations.

In order to recover the debris constituted by small mechanical parts which may be found wedged in the various parts of the fuel assemblies, a prior art device for the extraction of these foreign particles or parts comprises a grip which can be remotely controlled, from the edge of the well of the reactor. Such a device has is disclosed in French Patent Application 88-09025, assigned to FRAMATOME.

This extraction device, which takes the foreign body by gripping, does not permit the extraction of friable debris such as the fuel pellets which are subject to breakage when the grip is tightened. In the case of highly radioactive waste such as fuel pellets, there is a risk of contaminating the entire primary circuit.

It has also been proposed to use aspiration, filtration and delivery installations in which the water from the well is circulated, in order to filter the water and to retain the radioactive foreign bodies in the filter, before returning the water into the well of the reactor. However, in the case of highly radioactive bodies, the elimination of those bodies retained by the filter poses problems which are very difficult to resolve at the technical level. Moreover, the aspiration installation itself becomes contaminated after a certain operating time, so that it is very difficult to ensure its maintenance and its repair in the case of a break-down.

SUMMARY OF THE INVENTION

The object of the invention is therefore to propose a device for the recovery and elimination of radioactive waste, under water, in a well, comprising a means for the aspiration of the water from the well, the maintenance of which may be ensured in a very simple manner, which avoids any contamination of the aspiration means and which permits elimination of the radioactive waste to be carried out with very good biological protection.

To this end, the device according to the invention further comprises:

a column suspended in a vertical position from a handling and lifting means situated above the well, an aspiration head fixed at the end of the column opposite to the handling means, consisting of two hollow walls assembled to one another, between which there is placed a filtration wall pierced by openings separating the internal volume of the head into a first part comprising an aspiration opening communicating with the exterior and a second part connected via a conduit to the aspiration and delivery means, and remotely demountable connecting means connecting the two hollow walls of the aspiration head.

BRIEF DESCRIPTION OF THE DRAWINGS

In order to provide a good understanding of the invention, a description will now be given, by way of example, with reference to the accompanying figures, of an embodiment of a recovery device according to the invention.

FIG. 5 is a detailed view of a connecting means between the two walls of the aspiration head.

FIG. 6 is a plan view of the filter support of the aspiration head, seen in the direction of arrow 6 of FIG. 4.

FIG. 7 is a plan view of the filter of the aspiration head, seen in the direction arrow 7 of FIG. 4.

DESCRIPTION OF PREFERRED EMBODIMENT

Figure 1:
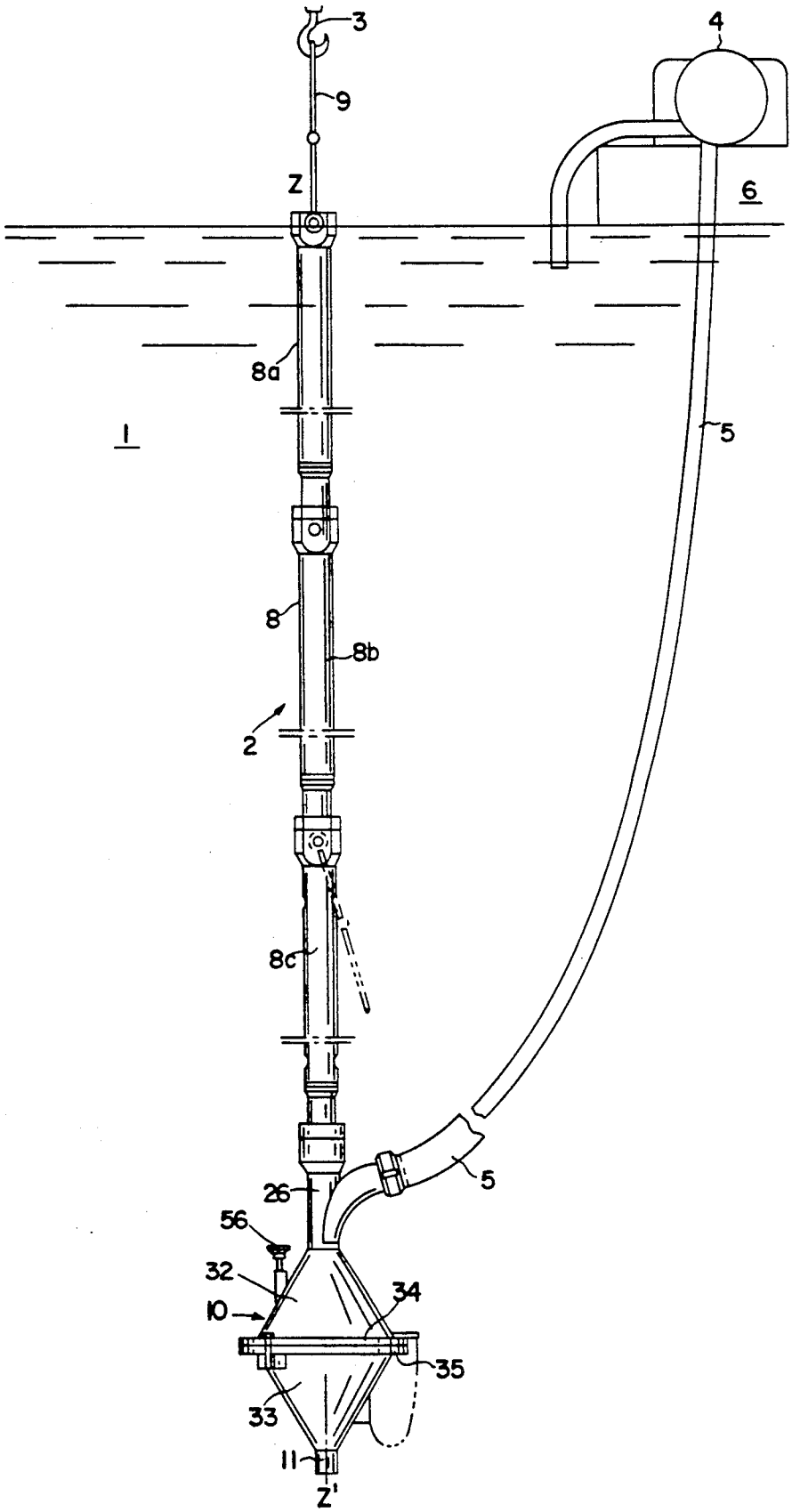
FIG. 1 is an elevation view of the entire device in service in the well of a pressurized-water nuclear reactor.

FIG. 1 shows an entire device recovery and for the elimination of radioactive waste in the water of the well 1 of a pressurized-water nuclear reactor.

The device is used during a shutdown phase of the nuclear reactor, the vessel of which is open and communicates with the well 1.

The device according to the invention comprises an aspiration pipe 2, a means for the handling and lifting of the pipe 2 which may consist of a travelling crane moving above the well of the reactor, the hook 3 of which is connected to the upper part of the pipe 2, and a pumping installation 4 connected by a flexible conduit 5 to the lower part of the pipe 2 ensuring the aspiration and the delivery of the water from the well. The pumping installation 4 placed on the edge 6 of the well 1, in the zone accessible to the operators ensuring the maintenance of the reactor, may be disposed in a biological protection enclosure to cover the case in which radioactive debris of small dimensions may be liable to come into contact with certain parts of the installation and to cause a certain contamination.

The pipe 2 consists of a column 8 comprising three successive sections 8*a*, 8*b*, 8*c* extending along its axis ZZ'.

The two upper sections 8*a* and 8*b* each consist of a tube of light alloy closed in a sealed manner at its ends, while the lower section 8*c* comprises openings in its wall permitting the filling thereof by water from the well. The column of water filling the section 8*c* ensures biological protection in the case where highly radioactive materials are found below the column 8.

A handling bar 9 is fixed at the end of the upper section 8*a* of the column, which is suspended with its axis ZZ' in a vertical position from the hook 3 of the crane of the reactor, by means of the handling bar 9.

At the lower end of the column 8 opposite to its end connected to the handling means 3, there is fixed an aspiration head 10 of difrustoconical shape, the upper part of which is connected to the flexible aspiration conduit 5 and the lower part of which comprises an aspiration connection 11 opening into the well 1.

The various sections of the column are demountable, in such a manner as to permit the use of a pipe 2 of length appropriate to carry out the recovery of waste, at any location within the vessel of the reactor.

Figure 2A:
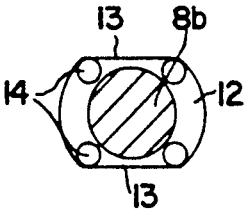
FIG. 2A is a cross-sectional view along line A—A of FIG. 2.
Figure 2:
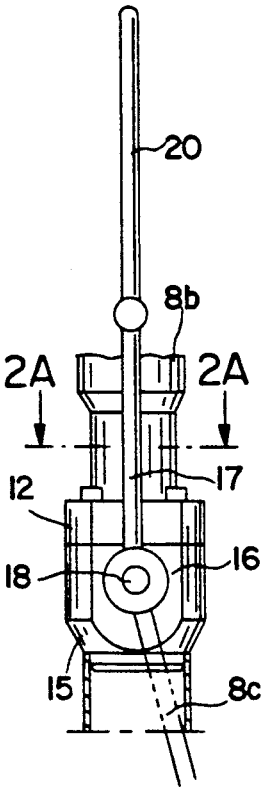
FIG. 2 is an elevation view, on a larger scale, of a zone of connection of two sections of the column of the device represented in FIG. 1.

FIG. 2 shows the upper part of the section 8*c* of the column 8 and its means for connection to the lower part of the section 8*b*.

As can be seen in FIGS. 2 and 2A, the lower part of the section 8*b* comprises a shoulder 12 having two flats 13 carrying four attachment screws 14 traversing and fixed in a captive manner on this shoulder.

The upper part of the section 8*c* is constituted by a widening 15, the shape of which in transverse cross-section corresponds to the shape of the shoulder 12 and which comprises, in particular, two flats 16 similar to the flats 13 of the shoulder 12. The widening 15 is pierced by four threaded blind holes each intended to receive a screw 14, in the course of the assembly of the sections 8*b* and 8*c* of the column. The assembly of the two sections is carried out by placing in coincidence the similar sections of the shoulder 12 and of the widening 15 and by screwing the screws 14 into the threaded holes of the widening 15.

Two suspension arms 17 are fixed via a shaft 18, on the widening 15, at the location of the flats 16. A handling bar 20 is connected to the end of the arms 17.

The suspension device consisting of the arms 17 and of the bar 20 may be displaced by pivoting about the shaft 18, the flats 13 and 16 in coincidence ensuring a sufficient displacement for the arms 17.

In FIG. 2, the suspension device has been represented in solid lines in its position permitting the handling of the lower section 8*c* and in broken lines in a withdrawn position similar to that represented in FIG. 1 and corresponding to the assembled position of the column.

Each of the successive sections of the column has an upper part similar to the upper part of section 8*c* and may permit the fixing of a suspension device consisting of arms and a bar. In particular, the handling bar 9 of the column 8 is connected to the upper section 8*a* by pivoting arms, in the same manner as the bar 20 of the lower section 8*c*.

The suspension devices of the various sections of the column are therefore used either for the suspension of the pipe during the use of the aspiration device or at the moment of mounting of the column, a sufficient number of sections being assembled to obtain the desired length.

Figure 3A:
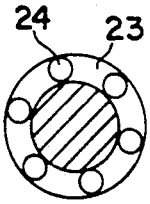
FIG. 3A is a cross-sectional view along A—A of FIG. 3.
Figure 3:
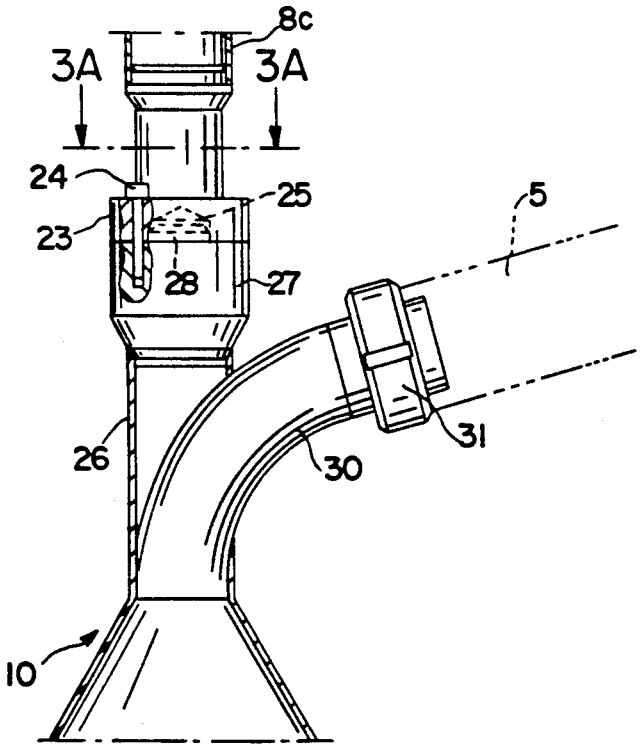
FIG. 3 is an elevation view, on a larger scale, of the lower part of the column of the device represented in FIG. 1.

FIG. 3 shows the lower part of the section 8*c* of the column 8 on which the aspiration head 10 is fixed.

The lower part of the section 8*c* consists of a shoulder 23 carrying six attachment screws 24 connected in a captive manner to the shoulder 23.

The shoulder 23 is furthermore pierced by a centering bore 25 opening at its lower end.

The aspiration head 10 comprises an upper connection 26 with a widening 27 at its end, the cross-section of which corresponds to the cross-section of the shoulder 23 of the section 8*c*. The widening 27 comprises, at its end, a stub 28 intended to come into engagement in the centering bore 25 of the shoulder 23. The widening 27 further comprises six equidistant threaded holes in positions corresponding to the positions of the screws 24.

The fixing of the aspiration head 10 at the lower end of column 8*c* is carried out by introducing the stub 28 into the opening 25 by orienting into the head in such a manner as to place the screws 24 in alignment with the threaded holes of the widening 27 and by ensuring the screwing of the screws 24 into the threaded holes.

The aspiration head 10 comprises an aspiration conduit 30 at its upper part, to which conduit the flexible conduit 5 may be connected via a screwed connection 31.

Figure 4:
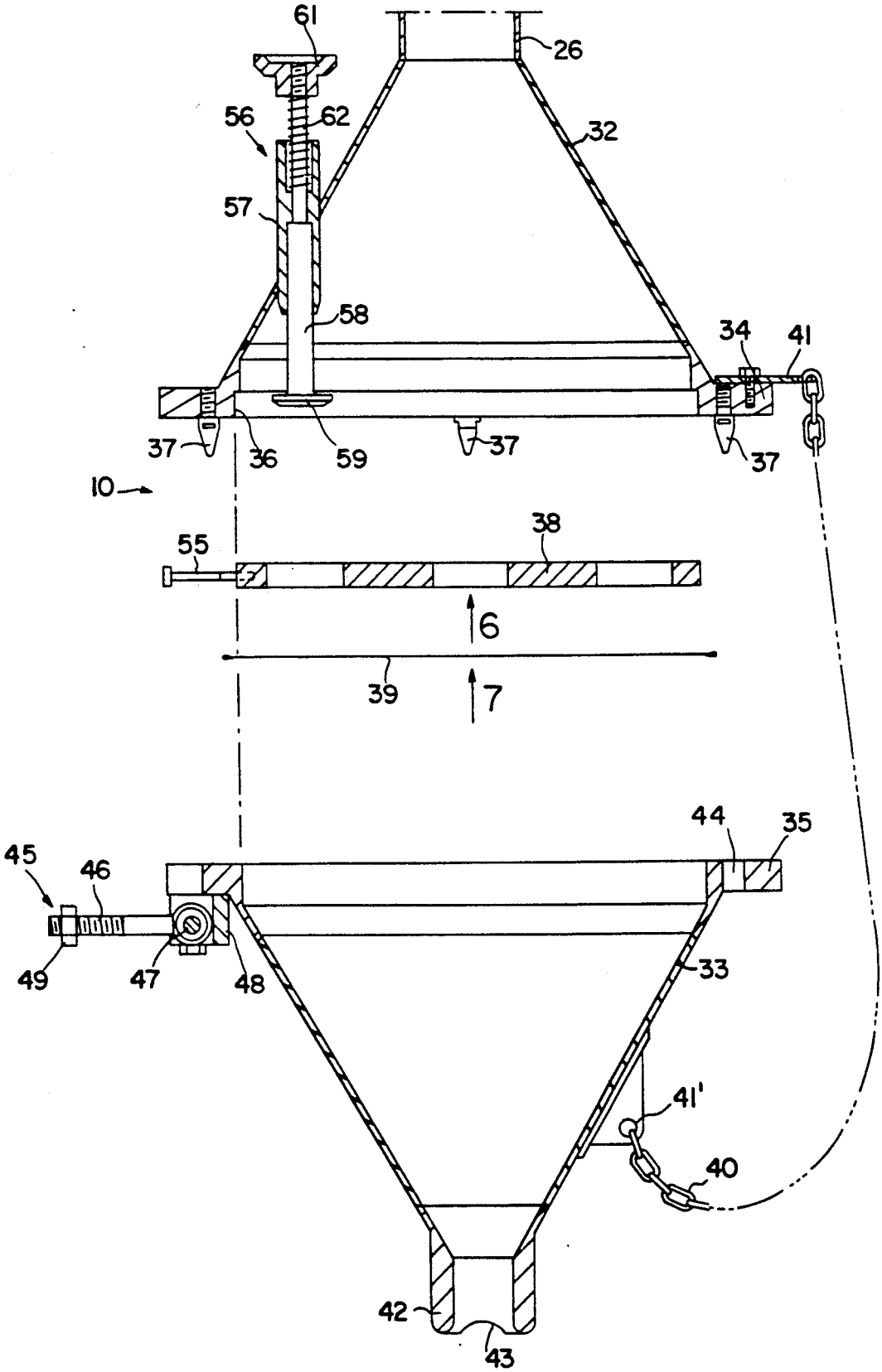
FIG. 4 is an exploded view, in axial cross-section, of the aspiration head of the device represented in FIG. 1.

FIG. 4 shows the assembly of the parts constituting the aspiration head 10 and their connecting means.

The casing of the aspiration head 10 is constituted by two hollow walls 32 and 33 of frustoconical shape, which may be connected, along their major bases in order to by flanges 34 and 35 form the difrustoconical casing represented in FIG. 1.

The frustoconical hollow wall 32 constituting the upper part of the aspiration head in the service position, as represented in FIG. 1, is solid at its end, along its minor base, with the tubular connection 26 to which the aspiration conduit 30 is connected.

The flange 34 is internally machined to form an annular seating 36 receiving, in the course of the mounting of the aspiration head, the peripheral edge of a filter support 38 against which the filter 39 of the aspiration head is placed.

The flange 34 carries centering pins 37 intended to be inserted upon mounting of the aspiration head, in holes 44 provided in the flange 35 of the frustoconical wall 33. The centering pins and holes may respectively be located at 90° from one another.

In the course of the assembly of the aspiration head, the filter 39 placed along the entire cross-section of the major base of the frustoconical walls 32 and 33 ensures a separation of the internal volume of the aspiration head 10 into a first part situated within the wall 32 and disposed at the upper part of the aspiration head and a second part situated within the frustoconical wall 33 and disposed at the lower part of the aspiration head 10.

The flange 34 carries a fixing plate 41 for a chain 40 connected at its other end to a small plate 41' fixed on the external wall of the lower frustoconical casing 33. The chain 40 permits, in the course of the demounting of the aspiration head 10, as represented in FIG. 4, the maintenance of a connection between the upper frustoconical wall 32 solid with the column and the lower frustoconical wall 33, while still permitting separation of the walls 32 and 33, sufficient for removal of the filter 39 from the aspiration head 10.

The lower frustoconical wall 33 is solid, at its end corresponding to the minor base of the cone, with a nozzle 42 comprising internal recesses 43. This nozzle places the internal volume of the aspiration head, in its second part situated below the filter 39, in communication with the external medium, which may consist of the water of the well of the reactor.

The flange 35 further carries two connecting devices such as 45, in diametrically opposite positions, permitting the assembly of the flanges 34 and 35 and thus of the walls 32 and 33 to constitute the casing of the aspiration head.

Each of the devices 45 comprises an eyelet screw 46 mounted so as to be articulated, via a shaft 47, on a bearing 48, solid with the flange 35. A nut 49 is engaged on the threaded end of the screw 46.

To assemble the two flanges and the two walls constituting the casing of the aspiration head, the two flanges are placed in coincidence, and the pins 37 come into engagement in the corresponding openings 44 of the flange 35. The eyelet screw 46 is withdrawn into a position parallel to the axis of the aspiration head, as represented in FIG. 5. The screw 46 then comes within a facing 50 machined radially, in the flange 34. The fixing of the two walls 32 and 33 is completed by tightening the nut 49 against the flange 34. The same operation is carried out for the two connecting devices 45.

FIGS. 4 and 6 show the filter support plate 38 which is constituted by a rigid plate pierced by holes 52 traversing the plate 38 and disposed on the plate in regular pattern.

The plate 38 also comprises two threaded radial holes 53, in diametrically opposite positions and opening onto the peripheral surface of the plate 38.

The plate 38, whose diameter is very slightly less than the diameter of the seating 36, is placed in this seating in the course of the mounting of the aspiration head. The flange 34 is pierced by two radial holes in diametrically opposite positions. The plate 38 is oriented within the seating 36 in such a manner as to place the threaded holes 53 in alignment with the holes traversing the flange 34. Screws 55 engaged into these holes placed in alignment permit the assembly of the filter support plate 38 and of the frustoconical wall 32 to be carried out.

The frustoconical wall 32 comprises an ejection device 56 constituted by a cylinder 57 traversing the wall 32, a rod 58 terminated by a pusher 59 mounted to slide in the cylinder 57, a thrust wheel 61 solid with the end of the rod 58 opposite to the pusher 52, and a return spring 62 intercalated between the thrust wheel 61 and the end of the cylinder 57. The cylinder 57 is disposed in such a manner that the pusher 59, the diameter of which is less than the diameter of the openings 52 of the filter support 38, is centered within one of the openings.

As can be seen in FIGS. 4 and 7, the filter 39 is constituted by a network of crossed steel wires, like a metallic net, fixed within an annular support 63, the internal diameter of which is substantially equal to the diameter of the plate 38. The annular support 63 constituting the border of the filter 39 is placed between the four centering pins 37 which, in the course of the mounting of the filter, enter into openings 44 of the flange 35.

In its assembled position, the wall of the filter 39 is in contact with the filter support plate 38 which ensures its retention against the pressure of the water passing through the aspiration head. The water passes through the filter support plate 38 via the openings 52.

When the aspiration head is in the service position, the first part of its internal volume, situated above the filter 39 and within the wall 32, is in communication with the branch 30 connected by the conduit 5 to the aspiration installation 4. The second part of the internal volume of the aspiration head below the filter 39 and within the wall 33 is in communication via the nozzle 42 with the external medium constituted by the water of the well.

When, in the course of the operations of maintenance and of recharging of the reactor, waste or debris has been located in the vessel, the column is mounted in such a manner as to provide access to the zones in which this waste or debris is located.

It may thus become necessary to carry out the mounting of a larger or smaller number of sections such as **8*a*, 8*b*, 8*c***, fixed end to end.

In an embodiment suitable for pressurized-water nuclear reactors of the current art, each column section has a length of 4.800 meters and the aspiration head a length close to 0.60 meter. The assembly of three successive sections **8*a*, 8*b*, 8*c*** thus permits the achievement of a length of 15 meters, which is sufficient to undertake the recovery of waste or debris in any location whatever of the vessel of the reactor.

The end of the aspiration head constituted by the nozzle 42 is placed in position in the immediate vicinity of the waste of which the recovery is being undertaken, it being possible for this positioning to be undertaken by means of the crane of the reactor and controlled by one or more submerged television cameras. It is thus possible to guide the end of the aspirating pipe to a specific location.

In the case where the waste is resting on an accessible surface, it will be possible to achieve the placement of the end of the nozzle on this surface around the waste, in order to ensure effective aspiration. The pumping and delivery installation 4 is activated; this performs the aspiration of the water from the well of the reactor by the nozzle 42 and a delivery thereof to the upper part of the well.

The water from the well is aspirated through the space formed between the internal recesses 43 and the surface on which the nozzle rests; this water which is aspirated and which circulates upwardly within the second part of the internal volume of the aspiration head below the filter, entrains the waste or debris which is retained against the surface of the filter 39, during such time as the aspiration in the head 10 is maintained.

The water which has passed through the filter 39 and which is aspirated by the pump 4 therefore no any longer contain radioactive elements, so that no contamination of the pumping installation is produced. This installation 4 may therefore be placed on the floor 6 in the vicinity of the well, in a zone in which the operators entrusted with the maintenance of the reactor work.

During the circulation of the water in the aspiration head, the filter 39 is maintained by the filter support 38 and does not undergo any damage, even in the case where a partial clogging of the filter gives rise to an increase in the pressure difference on either side of the filter.

When the recovery of the debris or waste located in the vessel has been completed, their elimination is carried out by placing a container in proximity to the working zone and by bringing the nozzle 42 of the aspiration head into coincidence with the opening of the container intended for the storage of the radioactive waste. The aspiration is terminated by cutting off the power supply to the motor of the pump 4, so that the waste and debris retained against the filter by the aspiration fall back into the second part of the internal volume of the aspiration head and are then guided by the smooth internal surface of the wall 33 towards the nozzle 42 and the container for the storage of the waste.

In the case where the debris recovered is highly radioactive, for example in the case of sintered pellets of combustible material, the filter becomes highly radioactive, so that it is necessary to undertake the demounting and elimination thereof before remounting the aspiration pipe, in order to avoid irradiating the operators ensuring the maintenance.

There is then performed the remote unscrewing of the nuts 49 of the eyelet screws 46, by means of a box key mounted on a column.

The eyelet screws 46 are set down towards the outside in such a manner as to separate the two flanges 34 and 35 and the two frustoconical walls 32 and 33.

These two walls are uncoupled and the filter is ejected into a container for the storage of radioactive waste by means of the pusher device 56 which can be remotely operated by applying pressure to the wheel 61; this causes the displacement of the pusher 59 within the opening 52 of the plate 38 until the pusher 59 comes into contact with the filter 39, which it ejects into the container for the storage of waste.

It should be noted that, in the course of the demounting of the aspiration head 10, the frustoconical lower wall 33 remains solid with the upper wall 32 and with the column, by virtue of the chain 40.

The aspirating pipe 2, the head 10 of which no longer encloses any radioactive material, may be remounted at the upper level of the well. The mounting of a filter 9 in the aspiration head is then carried out.

The aspirating pipe 2 is ready for a new operation of recovery and of elimination of radioactive waste.

In the case where the debris recovered on the surface of the filter by aspiration is slightly radioactive, the aspiration head 10 of the pipe is not demounted, it being possible for the filter to be used for a new operation.

The main advantages of the invention are to permit recovery of the radioactive waste under water and elimination of this waste, even where it is constituted by friable materials and/or by particles of small dimensions. Moreover, the recovery and elimination operations are carried out entirely remotely, under a large head of water; this eliminates the risk of irradiation of the operators.

Finally, the parts of the device which are placed at the upper level of the well or which are to be remounted at this level in the course of operation are not subjected to any contamination under the effect of the highly radioactive waste.

The aspiration head may have walls having an other than frustoconical geometric shape and the remotely demountable connecting means of these walls may be constructed in a different manner. The connecting means of the walls may have any number.

It is possible to use any pumping, aspiration and delivery installation disposed either above or on the base of the well and any filtration wall having characteristics adapted to the size of the waste and to the depth of intervention.

It is possible to connect a flexible pipe to the nozzle 42 of the aspiration head, and to fit to the end of the flexible pipe connections provided according to the location and the nature of the waste to be recovered (for example, recovery of debris from pellets within a fuel assembly).

The column of the aspiration pipe may be constituted by any number of sections connected to one another by connecting means of any type.

The aspiration pipe may be associated with any handling and lifting means for the placing in position thereof in the vessel. This means may be constituted by a handling and lifting means existing in the nuclear reactor or by a specially devised means.

The device according to the invention may be used in the case of any nuclear reactor cooled with light water.

We claim:

1. Device for underwater recovery and elimination of radioactive waste, in a well, said device comprising (a) means (4) for aspiration and delivery of said water from said well;

(b) a column (8) suspended in vertical position from a handling and lifting means (3) situated above said well;

(c) an aspiration head (10) attached to an end of said column (8) remote from said handling means (3) and consisting of first and second hollow walls (32, 33) assembled to one another;

(d) a filter (39) pierced by openings separating an internal volume of said aspiration head (10) into a first part comprising an aspiration opening (42) communicating with an exterior and a second part connected via a conduit (5) to said aspiration and delivery means (4); and (e) remotely demountable connecting means (45) connecting said first and second hollow walls (32, 22) of said aspiration head (10).

2. Device according to claim 1, wherein said hollow walls (32, 33) are of frustoconical shape and assembled to one another along major bases of said walls by means of flanges (34, 35).

3. Device according to claim 2, wherein said flanges (34, 35) respectively comprise pins (37) and centering openings (44) in corresponding locations.

4. Device according to claim 1, wherein said filter (39) is constituted by metallic wires disposed in accordance with a pattern, and wherein it is supported, within said aspiration head (10), on a filter support (38)

comprising a network of openings of large dimensions (52).

5. Device according to claim 1, wherein said hollow walls (32, 33) are connected to one another by flexible connecting means (40), enabling relative displacement of said walls to enable extraction of said filter (39) from said aspiration head (10).

6. Device according to claim 1, wherein said means for connecting said hollow walls (32, 33), enabling said walls to be remotely demounted, comprise at least two eyelet screws (46) pivotably mounted on one of said hollow walls (33) and each having a tightening nut (49) threaded thereon, an opening (50) in said second hollow wall (32) in a position corresponding to a position of a said eyelet screw (46) for introduction of said eyelet screw by pivoting into said opening (50) and screwing of said nut (49) into contact with a part of said second hollow wall (32).

7. Device according to claim 1, comprising means (56) for ejection of said filter (39), said ejection means comprising a cylinder (57) solid with one of said hollow walls (32), a rod (58) mounted for sliding movement within said cylinder (57) and terminating in a pusher (59), a thrust means (61) and a return spring (62) disposed around said rod (58) and intercalated between one end of said cylinder (57) and said thrust means (61).

8. Device according to claim 1, comprising an aspiration nozzle (42) fixed on said second hollow wall (33) at a location of said opening placing said second part of the internal volume of said aspiration head in communication with an exterior of said aspiration head (10).

9. Device according to claim 8, wherein said nozzle (42) comprises at least one internal recess (43) at an end of said nozzle.

10. Device according to claim 1, wherein said column (8) comprises a plurality of successive sections (8*a*, 8*b*, 8*c*) in an axial direction of said column, said sections being connected by removable assembly means (12, 14, 15).

11. Device according to claim 10, wherein said column comprises three successive sections (8*a*, 8*b*, 8*c*), in a vertical direction, two upper sections (8*a*, 8*b*) each consisting of a tube of light alloy sealingly closed at ends thereof, and a lower section (8*c*) being open to be filled with water from said well.

12. Device according to claim 10, wherein each one of said sections (8*a*, 8*b*, 8*c*) comprises, at one end thereof, means for attaching a handling bar (9, 20).

* * * * *